US008317573B2

(12) United States Patent
Hamill

(10) Patent No.: US 8,317,573 B2
(45) Date of Patent: Nov. 27, 2012

(54) DOUBLE ANNULAR ABRASIVE ELEMENT DRESSERS

(75) Inventor: Patrick Mark Hamill, County Tyrone (IE)

(73) Assignee: Seagate Technology LLC, Cupertino, CA (US)

( * ) Notice: Subject to any disclaimer, the term of this patent is extended or adjusted under 35 U.S.C. 154(b) by 1162 days.

(21) Appl. No.: 12/100,099

(22) Filed: Apr. 9, 2008

(65) Prior Publication Data

US 2009/0258581 A1 Oct. 15, 2009

(51) Int. Cl.
*B24B 53/00* (2006.01)

(52) U.S. Cl. ..... 451/56; 125/11.19; 451/443

(58) Field of Classification Search ..... 451/548, 451/550, 72, 271, 443, 444, 56; 125/11.19
See application file for complete search history.

(56) References Cited

U.S. PATENT DOCUMENTS

| | | | | |
|---|---|---|---|---|
| 2,867,063 | A * | 1/1959 | Metzger | 451/548 |
| 3,397,493 | A * | 8/1968 | Highberg | 451/488 |
| 3,662,498 | A * | 5/1972 | Caspers | 451/269 |
| 5,938,506 | A * | 8/1999 | Fruitman et al. | 451/41 |
| 6,254,461 | B1 * | 7/2001 | Benning et al. | 451/56 |
| 6,439,987 | B1 * | 8/2002 | Ripper et al. | 451/443 |
| 7,500,904 | B2 * | 3/2009 | Minami et al. | 451/56 |

* cited by examiner

*Primary Examiner* — Robert Rose
(74) *Attorney, Agent, or Firm* — Mitchell K. McCarthy; McCarthy Law Group

(57) ABSTRACT

An apparatus and associated method for dressing a workpiece. A first annular abrasive dressing element is attached to a base, an inner arcuate edge of the first annular abrasive dressing element defining a cavity. A second annular abrasive dressing element is also attached to the base and disposed in the cavity, an outer arcuate edge of the second annular abrasive dressing element noncontactingly separated from the inner arcuate edge of the first annular abrasive dressing element defining a circumferential space therebetween.

20 Claims, 10 Drawing Sheets

DOUBLE ANNULAR ABRASIVE ELEMENT DRESSERS

BACKGROUND

Magnetic disks and disk drives are conventionally employed for storing data in magnetizable form. Preferably, one or more disks are rotated on a central axis in combination with data transducing heads positioned in close proximity to the recording surfaces of the disks and moved generally radially with respect thereto. Magnetic disks are usually housed in a magnetic disk unit in a stationary state with a magnetic head having a specific load elastically in contact with and pressed against the surface of the disk.

The increasing demands for higher areal recording density impose increasingly greater demands on flying the head lower because the output voltage of a disk drive (or the readback signal of a reader head in disk drive) is proportional to 1/exp (HMS), where HMS is the space between the head and the media. Therefore, a smooth recording surface is preferred, as well as a smooth opposing surface of the associated transducer head, thereby permitting the head and the disk to be positioned in closer proximity with an attendant increase in predictability and consistent behavior of the air bearing supporting the head.

The formation of each of the layers of the recording medium is based in part on the surface conditions of the previous layer. Thus, it is important that the non-magnetic substrates meet a strict set of requirements so that the subsequent layers formed thereon may be properly arranged. For example, if the overall surface of the substrate has an undesirable curvature, the head will not always be appropriately spaced from the media. Thus, the substrate must have an overall flatness. On a smaller scale, the waviness of the surface of the substrate must also meet specific requirements. If there are significant scratches or bumps in the surface, those scratches and bumps may show up in the subsequent layers. On an even smaller scale, the roughness of the surface on the scale of Angstroms must also be very low. If the roughness is too high, the head will not be able to glide smoothly over the media. As a result, the recording media will be defective. Therefore, it is very important that the surface of the substrate meet strict requirements with respect to smoothness.

In order to smooth the surface of the substrates, they are first ground to a desired width, flatness and waviness using grind stones. In many applications both sides of the substrates are utilized for recording media. Once the substrates are ground to meet these requirements they are further processed to meet small scale smoothness requirements. The small scale roughness is usually controlled by a polishing process after grinding.

There is, however, a need for a dresser which will dress grind stones such that they operate at a high removal rate and produce substrates with good mechanical surface characteristics.

SUMMARY OF THE INVENTION

In some embodiments a workpiece dresser apparatus is provided, having a base and a first annular abrasive dressing element attached to the base, an inner arcuate edge of the first annular abrasive dressing element defining a cavity. A second annular abrasive dressing element is also attached to the base and disposed in the cavity, an outer arcuate edge of the second annular abrasive dressing element noncontactingly separated from the inner arcuate edge of the first annular abrasive dressing element defining a circumferential space therebetween.

In some embodiments a method is provided including steps of obtaining a workpiece; obtaining a workpiece dresser apparatus having a base, a first annular abrasive dressing element attached to the base such that an inner arcuate edge of the first annular abrasive dressing element defines a cavity, and a second annular abrasive dressing element attached to the base and disposed in the cavity, an outer arcuate edge of the second annular abrasive dressing element noncontactingly separated from the inner arcuate edge of the first annular abrasive dressing element defining a circumferential space therebetween; and rotating the base to dress the workpiece with the first and second annular abrasive dressing elements.

In some embodiments a workpiece processing apparatus is provided having a mount for supporting the workpiece, and means for dressing the supported workpiece via movements of a first annular abrasive element and a second annular abrasive dressing element in relation to the workpiece in the mount.

These and various other features and advantages will be apparent from a reading of the following detailed description. As will be realized, this invention is capable of other and different embodiments, and its details are capable of modifications in various obvious respects, all without departing from this invention. Accordingly, the drawings and description are to be regarded as illustrative in nature and not as restrictive.

BRIEF DESCRIPTION OF THE DRAWINGS

The following detailed description of the embodiments of the present invention can best be understood when read in conjunction with the following drawings, in which the features are not necessarily drawn to scale but rather are drawn as to best illustrate the pertinent features, wherein.

DETAILED DESCRIPTION OF THE PREFERRED EMBODIMENT

The invention relates to grinding stone dressers, and particularly relates to solid wheel dressers. The invention has particular utility in the fabrication of disk-shaped substrates for use in the manufacture of magnetic data/information storage and retrieval media, e.g., hard disks.

In one embodiment, the invention provides a dresser for dressing grinding stones that includes a dresser base in the form of a circle and a dressing element disposed on a top surface of the dresser base. The dressing element includes two solid concentric wheels and is formed of an abrasive material within a matrix of another material.

In another embodiment, the invention provides a grind stone dressing apparatus for dressing upper and lower grind stones. The apparatus includes the two grind stones as well as a plurality of dressers positioned between the grind stones. The plurality of dressers each include a dresser base in the form of a circle and a dressing element disposed on a top surface of the dresser base. The dressing element includes two solid concentric wheels and is formed of an abrasive material within a matrix of another material. During operation the dressers and the grind stones are moved relative to one another.

In yet another embodiment, the invention provides a method of operating a dressing apparatus for dressing upper and lower grind stones. The method includes steps of providing upper and lower grind stones as well as a pinion and plurality of dressers between the grind stones. The dressers are engaged with the pinion. Each of the dressers includes a dresser base in the form of a circle and a dressing element disposed on a top surface of the dresser base. The dressing element includes two solid concentric wheels and is formed of an abrasive material within a matrix of another material. The pinion is rotated in order to move the dressers with respect to the grind stones, thereby dressing the grind stones.

Figure 1:
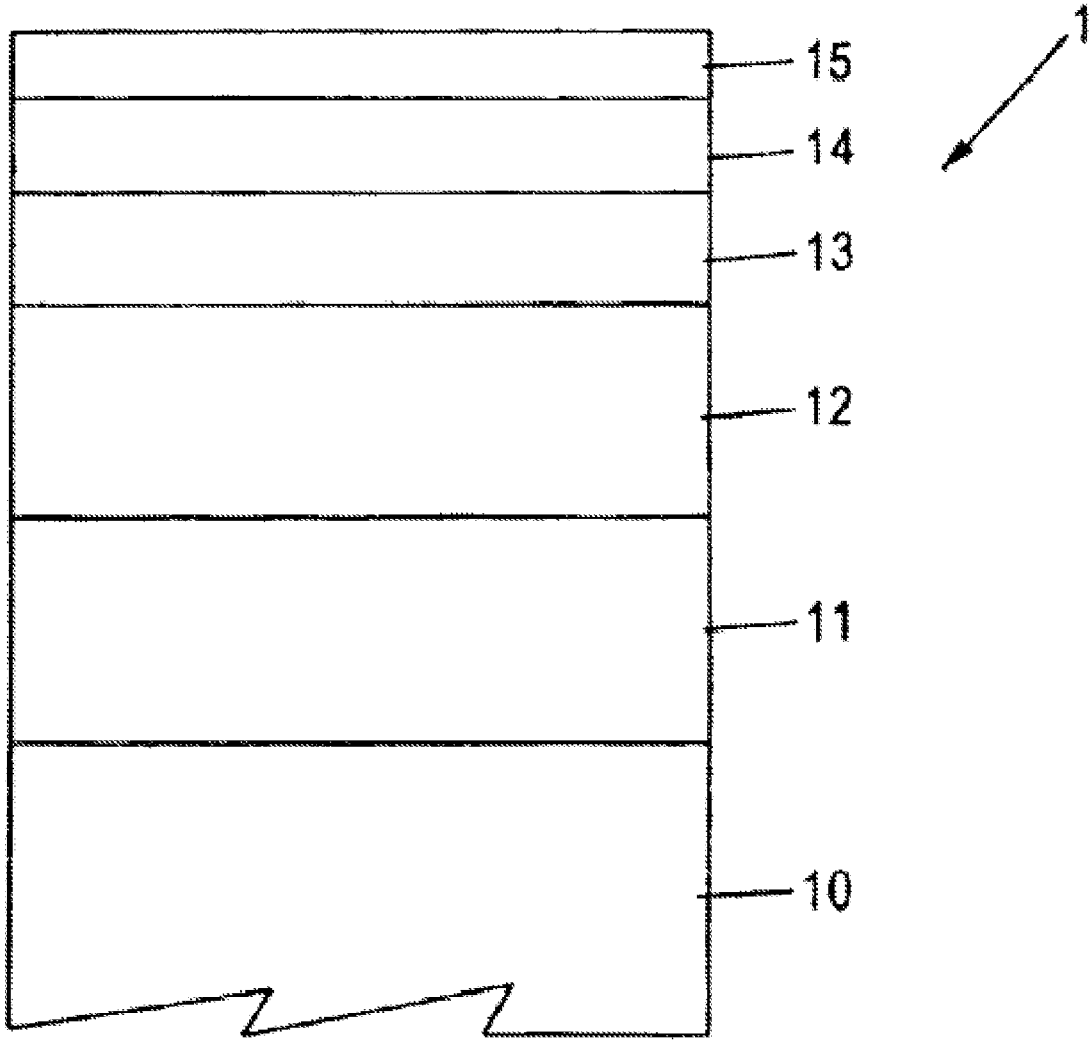
FIG. 1 illustrates, in schematic, simplified cross-sectional view, a portion of a thin film magnetic data/information storage and retrieval medium.

A portion of a recording medium 1 utilized in disk form in computer-related applications is schematically depicted in FIG. 1 and comprises a non-magnetic substrate 10, preferably of metal, e.g., an aluminum alloy, or an aluminum-magnesium (Al—Mg) alloy, having sequentially deposited thereon a plating layer 11, such as of amorphous nickel-phosphorus (NiP), a polycrystalline underlayer 12, preferably of chromium (Cr) or a Cr-based alloy, a magnetic layer 13, e.g., of a cobalt (Co)-based alloy, a protective overcoat layer 14, preferably containing carbon (C), e.g., diamond-like carbon ("DLC"), and a lubricant topcoat layer 15, preferably of a perfluoropolyether compound applied by dipping, spraying, etc.

In a processing method used for grinding substrates, a grinding apparatus is used that includes two grinding stones. Preferably, the grinding stones include an abrasive material held within a matrix. An exemplary grinding wheel includes a hard abrasive within a polyvinyl acetal (PVA) matrix. The substrates are then loaded into the grinding apparatus within a number of process carriers. The process carriers are preferably formed of a durable but soft material that limits substrate damage in contact with carrier, such as Teflon Glass, Fiber Glass or an Aramid/Kevlar composite, and can carry a plurality of carriers. For example, the grinding apparatus may hold 5 or 6 substrate carriers, with each carrier including 10 substrates held therein.

Each of the grinding stones can be independently rotatable. Additionally, the grinding apparatus is operable to move the process carriers with respect to the grinding stones in order to wear down and flatten the substrate surfaces. In an embodiment, the grinding apparatus can include a rotatable pinion between the two grinding stones. The process carriers are circumferentially positioned around the pinion in a planetary configuration directly between the stones. Further, an outer ring is positioned around the carriers and pinion. The pinion, process carriers and outer ring are preferably engaged, such that rotational movement of either the pinion or the outer ring causes the carriers to both rotate and move in a circle around the stones. In one embodiment, the pinion, carriers and outer ring are all engaged using gear teeth. Particularly, in those embodiments the planetary configuration is constructed of the pinion supporting a sun gear, the carriers are the planet gears, and at least one of the sun gear and the ring gear is selectively rotatable to impart rotation to the planet gears. As a result of relative movement between the substrates and the adjacent grind stones, the substrates are effectively ground.

Over time, as the grind stones are used to perpetually grind substrates, the material of the substrates may begin to collect on the stones. This reduces the effectiveness of the grind stones. To further complicate this problem, the material deposited on the stone may react and become more detrimental to the grind stone's operation. For example, if the stones are used to grind aluminum substrates, the aluminum that collects on the surface of the stones may oxidize into a hard layer of aluminum oxide. This hard layer of aluminum oxide has very negative effects on the grind stone operation.

There are two different characteristics that affect the operational ability of the grind stone operation. The first is with respect to the mechanical properties of the substrates they produce. In other words, the grind stones may be evaluated based on the flatness and waviness of the substrates that are produced with those grind stones. Another important characteristic of the grind stones is their ability to remove material from the substrates quickly. High removal rate of the substrate material is very important to the operation of the grinding apparatus. Higher removal rate translates into higher production, which reduces costs. Both the removal rate and the mechanical properties of the produced substrates are affected over time by the deposition of material on the grind stones.

In order to renew the operating ability of the grind stones, they must periodically be dressed. In most modern systems, if two grind stones are used in a grinding apparatus, both stones are dressed simultaneously. The dressers are placed between the two grind stones in place of the process carriers and the operation of the grinding apparatus is carried out. As a result there is relative motion between the grind stones and the dressers. However, instead of the grind stones acting to grind a substrate, the dressers act to dress the grind stones.

The capability of the dressers to successfully dress the grind stones can be measured based on the performance of the grind stones after they have been dressed. In other words, if the dressers successfully dress the grind stones, they will operate with a high removal rate and will yield substrates with good mechanical surface conditions. In other words, low waviness and flatness.

Figure 2:
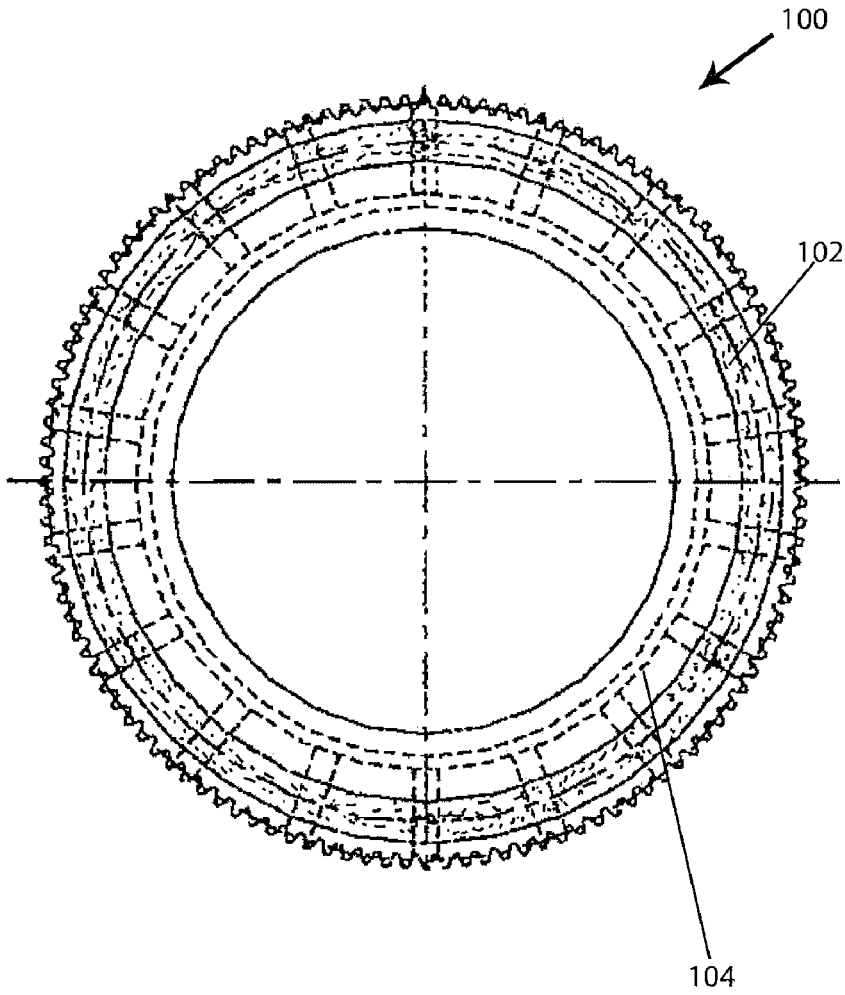
FIG. 2 shows a pellet dresser.

There are two different types of dressers that are used to dress grind stones. The first type is shown in FIG. 2 and includes a solid wheel dressing element 102 that is formed in the shape of a circle around the body 104 of the dresser. Solid wheel dressers 100 are advantageous because the entire dressing element is made out of a unitary surface. As a result, the dresser may have a very flat dressing surface. This helps solid wheel dressers dress grind stones to a very even and flat surface. As a result, grind stones that are dressed with solid wheel dressers preferably perform very well with respect to the mechanical surface properties of the substrates. In other words, the substrate surface is usually very flat and has low waviness.

On the other hand, grind stones that are dressed using solid wheel dressers preferably do not grind the substrates at a high removal rate. As a result, the freshly dressed grind stones do not yield high productivity. Accordingly, the manufacture of substrates using these grind stones increases cost. For many applications it is not economical to dress the grind stones using solid wheel dressers.

Figure 3:
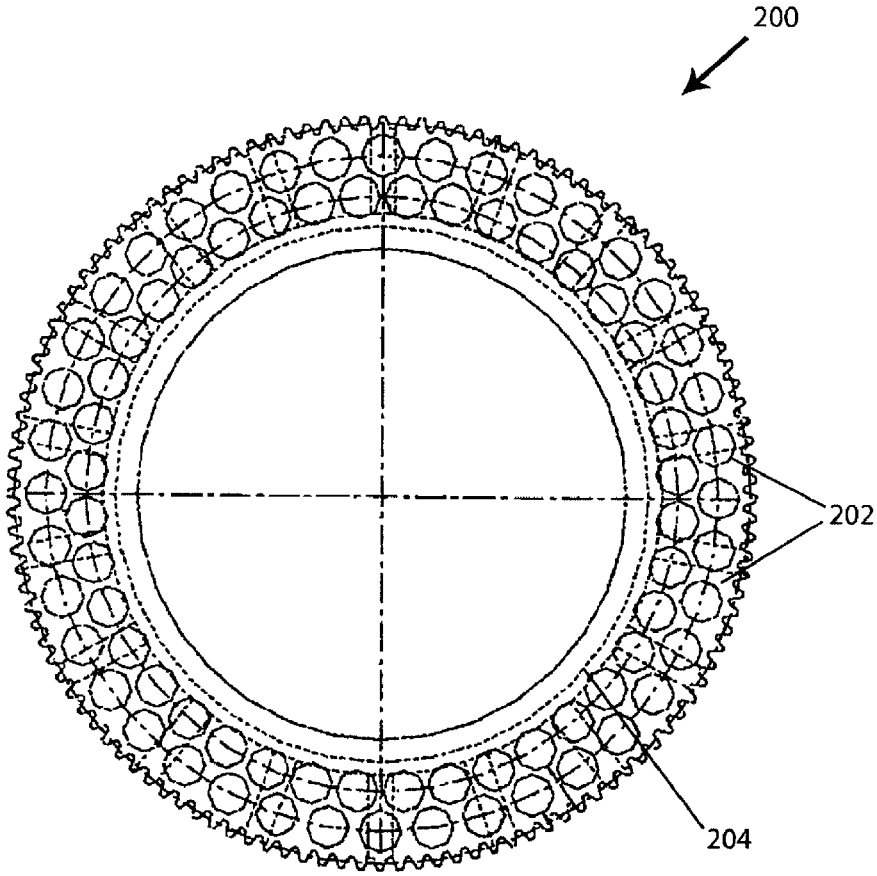
FIG. 3 shows a solid wheel dresser.

The other dresser preferably has the opposite characteristics, producing grind stones that yield lower quality with respect to mechanical surface characteristics at a higher production rate. These dressers, an example of which is shown in FIG. 3, are pellet dressers 200 and include a large number, e.g. 80, of individual dressing elements on its top surface 204 in the form of pellets 202. Each pellet 202 provides a different cutting surface on the dresser. The large number of cutting surfaces of the pellet dresser 200 results in a dressed grind stone that operates at a very high removal rate. Thus, with the use of pellet dressers, the grinding apparatus can produce large numbers of substrates at low cost. However, as the storage density of magnetic recording media increases, the requirements for surface properties intensifies. High density recording media often can no longer be produced using grind stones that are dressed with pellet dressers. The surfaces of the substrates do not meet production requirements with respect to waviness or flatness.

The present invention addresses and solves the problems of the prior art by a dresser structure that delivers advantageous performance superior to both the pellet dresser and the single solid wheel dresser. The present invention, in one embodiment, provides a dresser with a double concentric solid wheel dressing element. The dresser is shown in FIGS. 4*a*-4*c*.

Figure 4A:
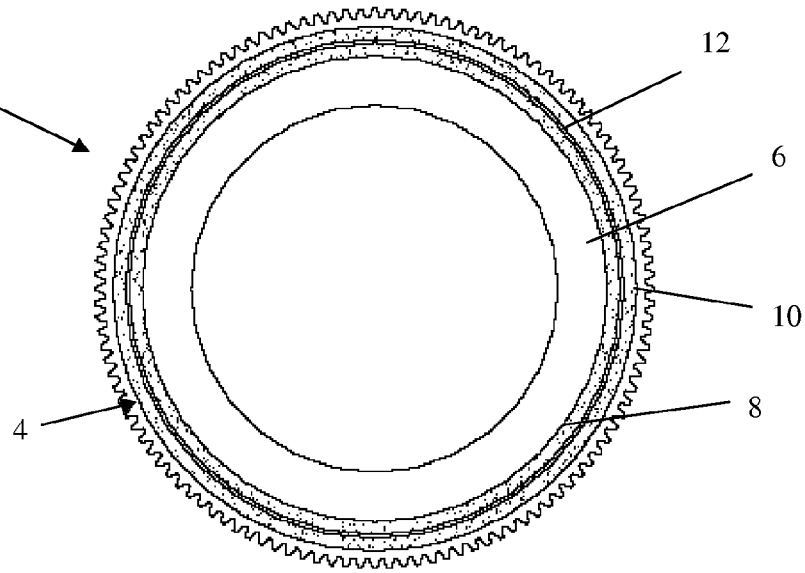
FIG. 4*a*-4*c* show a dresser in accordance with the invention.
Figure 4B:
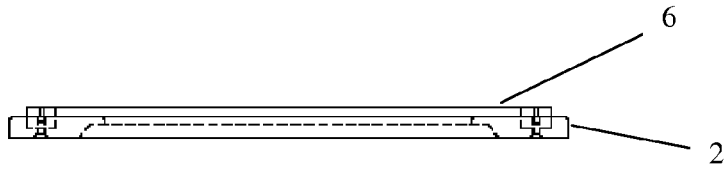
Figure 4C:
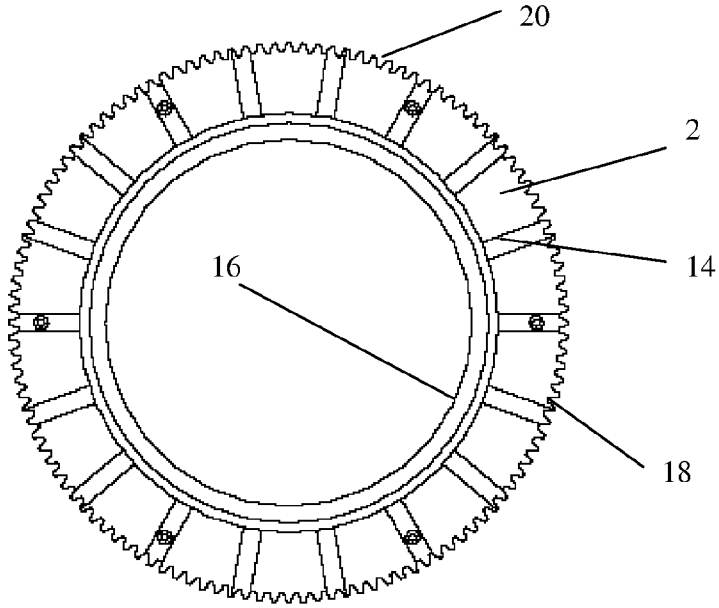

FIG. 4*a* shows a top view of the double concentric solid wheel dresser 1 of the invention. As shown, it includes two concentric solid wheel dressing elements 4 on its top surface 6, including an inner wheel 8 and an outer wheel 10. Each of the dressing elements 4 is formed of a matrix material including an abrasive. For example, the matrix material may be a metal or hard plastic and the abrasive can include diamonds, sintered diamonds, corundum, or other forms of aluminum oxide. The dressing elements 4 are attached to a dresser base 2, which holds the dressing element 4 in place.

The concentric solid wheel dressing elements 4 are separated by a groove 12 formed therebetween. The groove 12 presents a further advantage by providing a channel that allows grind sludge that is removed from the surface of the grind stone to be discharged such that it does not interfere with further dressing. The groove 12 may be cut out of a unitary structure that includes both the inner 8 and outer 10 solid dressing wheels. By forming the two circumferential dressing elements 4 out of the same unitary structure, there is a much higher likelihood that the surface of the two dressing elements 4 will lie on the same plane. In an alternative embodiment, the two concentric dressing wheels can each be separately and independently formed.

At its bottom, the dresser base may include grooves 14 extending from an inner diameter 16 of the dresser to an outer diameter 18 of the dresser. These grooves also allow for the discharge of grind sludge that is removed from the stone surface. The sides of the dresser can include gear teeth 20 that are used for applying rotational motion to the dressers. The gear teeth 20 are designed to match with gear teeth included on an inner pinion and outer ring of the dressing apparatus as described below.

Although the dressers are described as having only dressing elements on their top, it is also foreseeable that they may include the double concentric dressing wheels on both sides. Additionally, although the invention is described with respect to a dresser having two concentric dressing wheels, it is also possible that they include more than two concentric dressing wheels.

Figure 5:
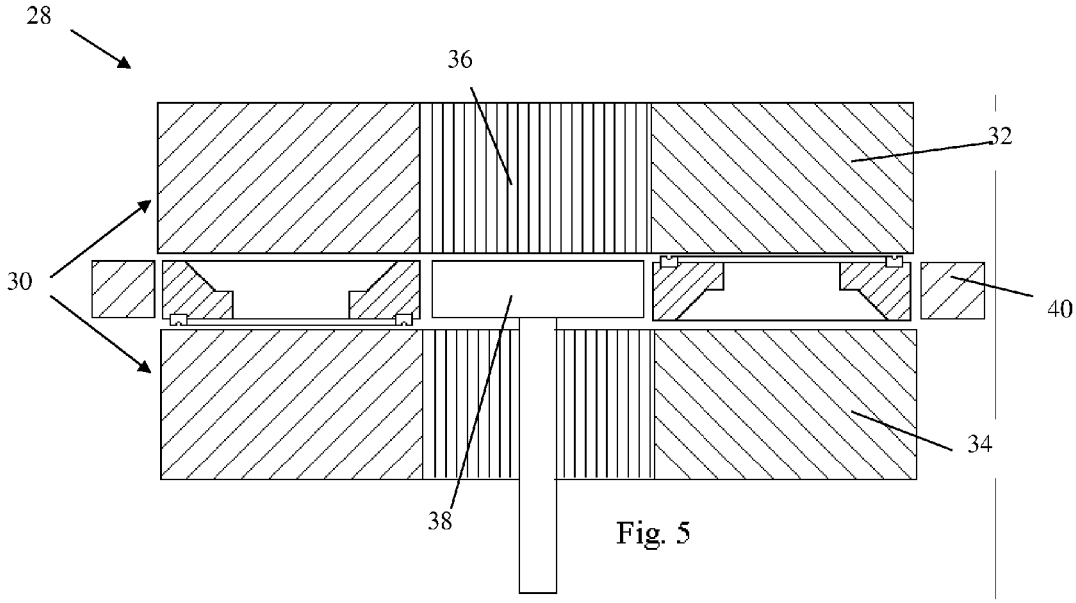
FIG. 5 shows a grind stone dressing apparatus in accordance with the invention.

A dressing apparatus 28 in accordance with the invention is shown schematically in FIG. 5. It includes two grind stones 30, an upper grind stone 32 and a lower grind stone 34. Each of the grind stones 30 has an inner diameter 36 and an outer diameter. The grind stones 30 may each be independently rotatable. Alternatively, either grind stone 30 or both grind stones 30 may be stationary if preferred. To dress the grind stones 30 the aforementioned dressers 1 are placed between the two grind stones 30 such that they contact both the upper and lower grind stones 30. To dress the grind stones 30, the dressers 1 are moved relative to the grind stones. In a preferred embodiment, the dressers are moved using parts of the dressing apparatus 28 as described in the following, however, it is foreseeable that the dressers 1 may be held in place while the grind stones 30 are moved. A pinion 38 is placed between the two grind stones 30 and has an outer diameter that is similar to that of the inner diameter 36 of the grind stones 30. Further, the pinion 38 is approximately coaxial with the two grind stones 30. A plurality of dressers 1 are placed around the pinion 38 such that they engage with the pinion 38. In one embodiment, the pinion 38 includes gear teeth that match the gear teeth 20 of the dresser. Outside of the dressers 1 is an outer ring 40 that is also engaged with the dressers 1. Thus, the dressers 1 and pinion 38 form a planetary formation. Again, the dressers 1 and outer ring 40 may be engaged with gear teeth that are supplied on the outer ring 40 to match the gear teeth 20 of the dressers 1. If either of the outer ring 40 or the pinion 38 are individually moved it will result in the dressers 1 moving about the surface of the grind stones 30 while rotating. Further, both the pinion 38 and outer ring 40 may move in opposite directions in order to move the dressers more quickly. In a preferred embodiment the movement of the dressers is actuated by the pinion 38, with the outer ring 40 remaining stationary.

In order to dress both surfaces at once, some of the dressers 1 may face the upper grind stone 32 while the remaining dressers 1 face the lower grind stone 34. As the dressing apparatus is operated, the dressers 1 facing the upper grind stone 32 dress that stone 32, while the dressers 1 facing the lower grind stone 34 dress that stone 34. In a preferred embodiment, six dressers are used, with each dresser facing a different direction than its neighbors. That is, the dressers alternate up and down around the surface of the grind stones 30. This will help uniformly dress the entire surface of both of the grind stones 30.

EXAMPLES

Dressers in accordance with the invention were made with the following specific characteristics. The performance of these dressers was then compared to prior art dressers which are described below. The dresser made in accordance with the invention included a dresser base formed of stainless steel with gear teeth around its circumference. The dresser had a pitch diameter of 300 mm and an inner diameter of 200 mm.

A unitary structure dressing element was attached to the top surface and had the form of a wheel. An inner diameter of the wheel is 254 mm and an outer diameter is 286 mm. Thus, the wheel was in the form of a ring that was 16 mm wide. At the center of the circumferential wheel was a 2 mm groove placed between two concentric 7 mm solid dressing wheels. The dressing element of the invention was formed of a sintered bronze/diamond in a metal mold.

Prior art dressers were also made to use in a comparison with those of the invention. The prior art dressers were formed identically to the inventive dressers except in the shape of the dressing element. A solid wheel dresser 100, shown in FIG. 2 was made with a single solid wheel dressing element that is 16 mm wide. The solid wheel dressing element was placed on a surface 104 of the dresser base and had an inner diameter of 254 mm and an outer diameter of 270 mm. A pellet dresser 200, shown in FIG. 3 was made with 80 pellets 202 on its front surface 204. The pellets were distributed circumferentially around the circumference of the dresser base in two rings. Each pellet was formed in a 17 mm diameter hole, and the two rings had diameters of 242 mm and 274 mm, respectively. The dressing elements were formed of the same material as those of the invention.

A series of tests were conducted to compare the dressers of the invention to the prior art. To test the dressers, grind stones such as that described above were dressed with each of the three tested dressers for approximately 2-3 minutes. The grind stones were then used to grind aluminum substrates down 65 mm. Periodically, as the grind stones began to perform poorly, the grind stones were redressed using the same dressers. These tests were carried out over consecutive days to ensure similar conditions between tests.

Figure 6:
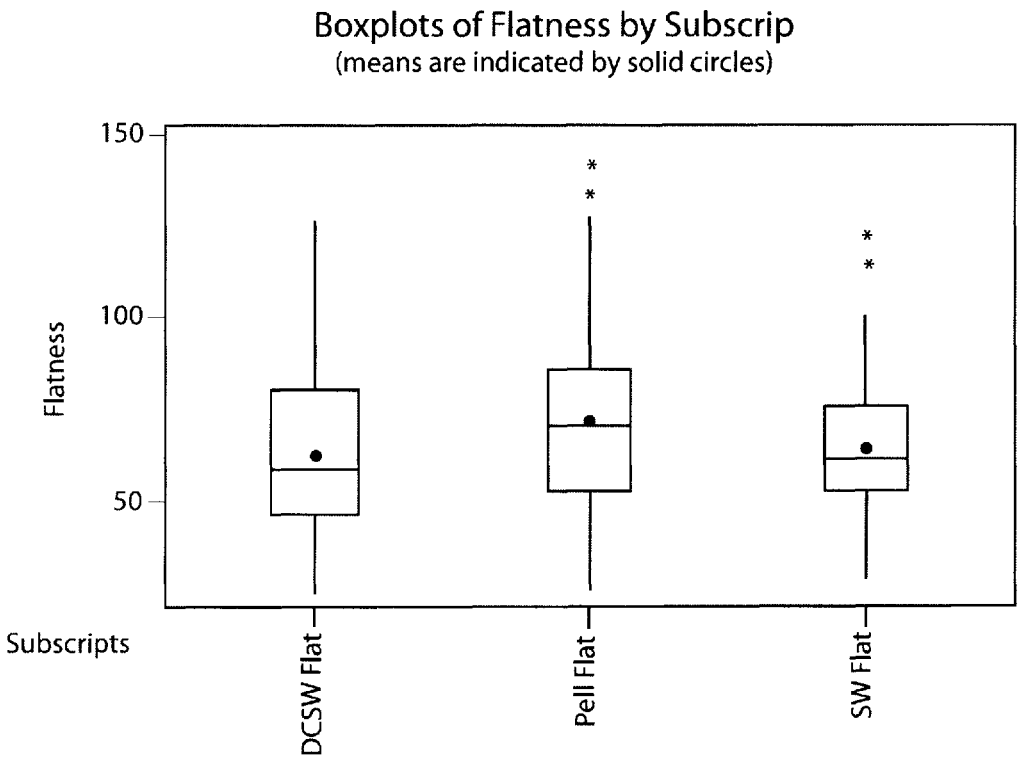
FIG. 6 shows a plot comparing the flatness of substrates ground with a stone grinding apparatus dressed in accordance with the invention and the prior art.
Figure 7:
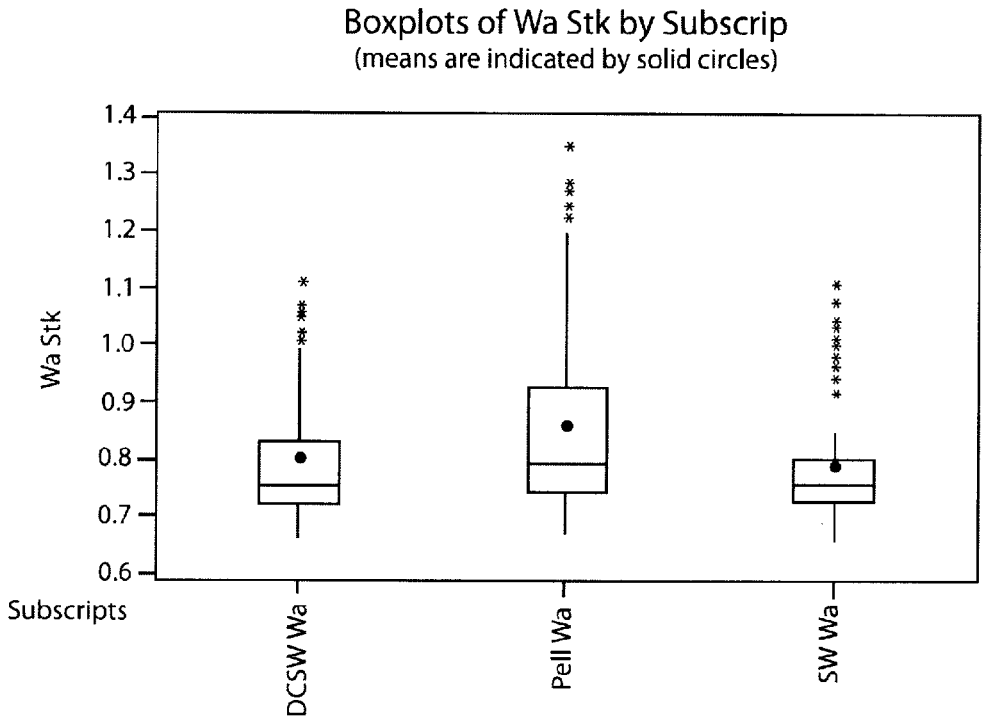
FIG. 7 shows a plot comparing the waviness of substrates ground with a stone grinding apparatus dressed in accordance with the invention and the prior art.
Figure 8:
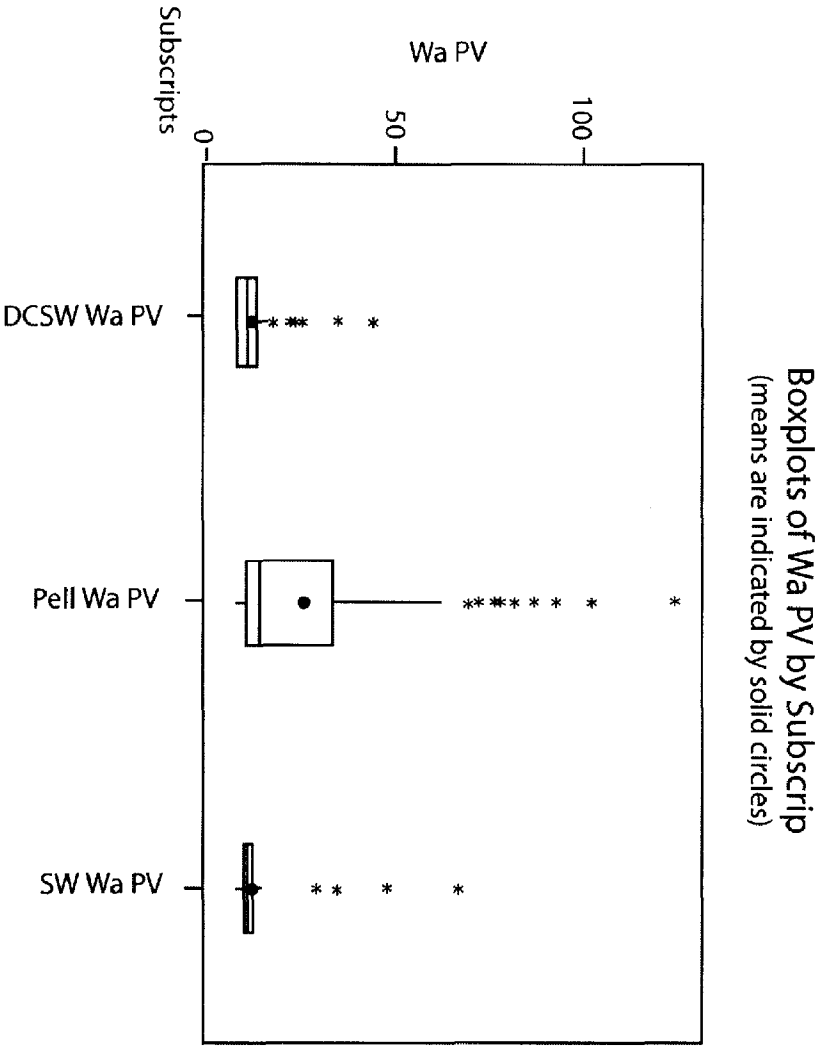
FIG. 8 shows a plot comparing the peak to valley waviness of substrates ground with a stone grinding apparatus dressed in accordance with the invention and the prior art.

Data comparing the performance of the dressers is shown in FIGS. 6-10. FIGS. 6-8 clearly show that the double concentric solid wheel (DCSW) dressers of the invention perform as well as the single solid wheel dressers (SSW) with respect to surface conditions. The flatness, general waviness (Wa Stk), and peak to valley waviness (Wa PV) averages shown in FIGS. 6-8 respectively, were much lower for substrates made with the grind stones that were dressed with the dressers of the present invention than for the Pellet dressers (Pell). Instead, the substrates made via the use of the present invention had mechanical characteristics much more similar to the solid wheel dressers.

Figure 9:
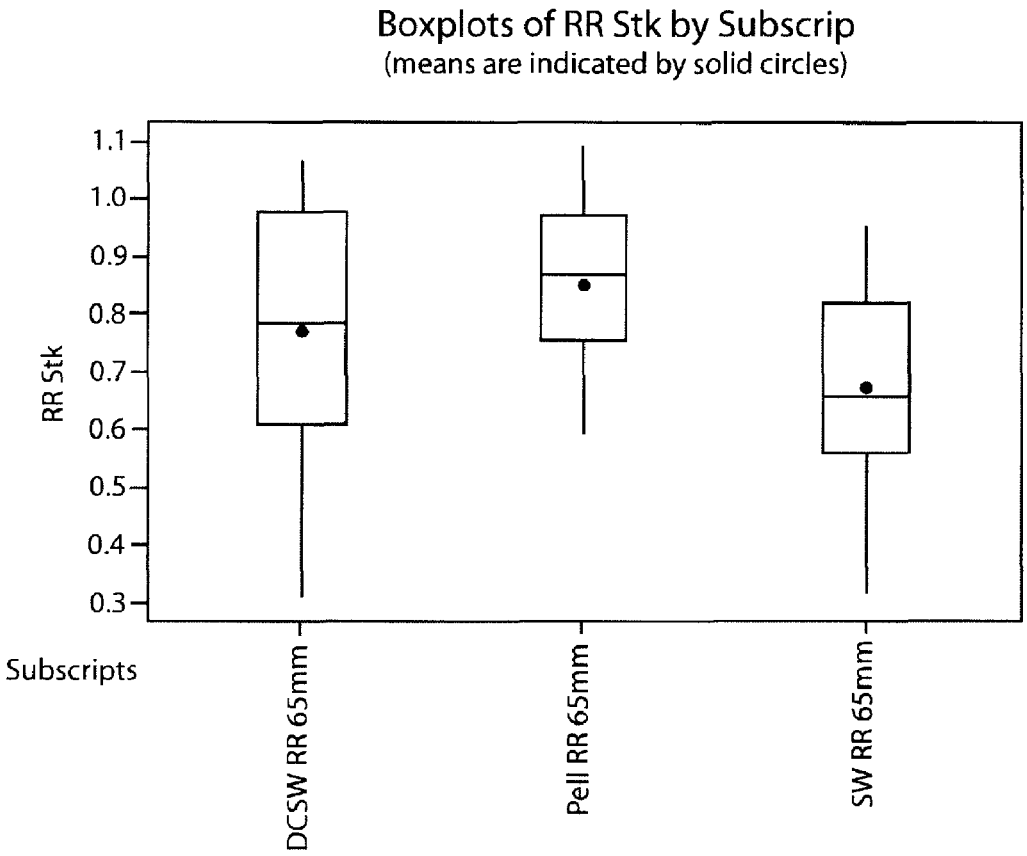
FIG. 9 shows a plot comparing the removal rate of substrates ground with a stone grinding apparatus dressed in accordance with the invention and the prior art.
Figure 10:
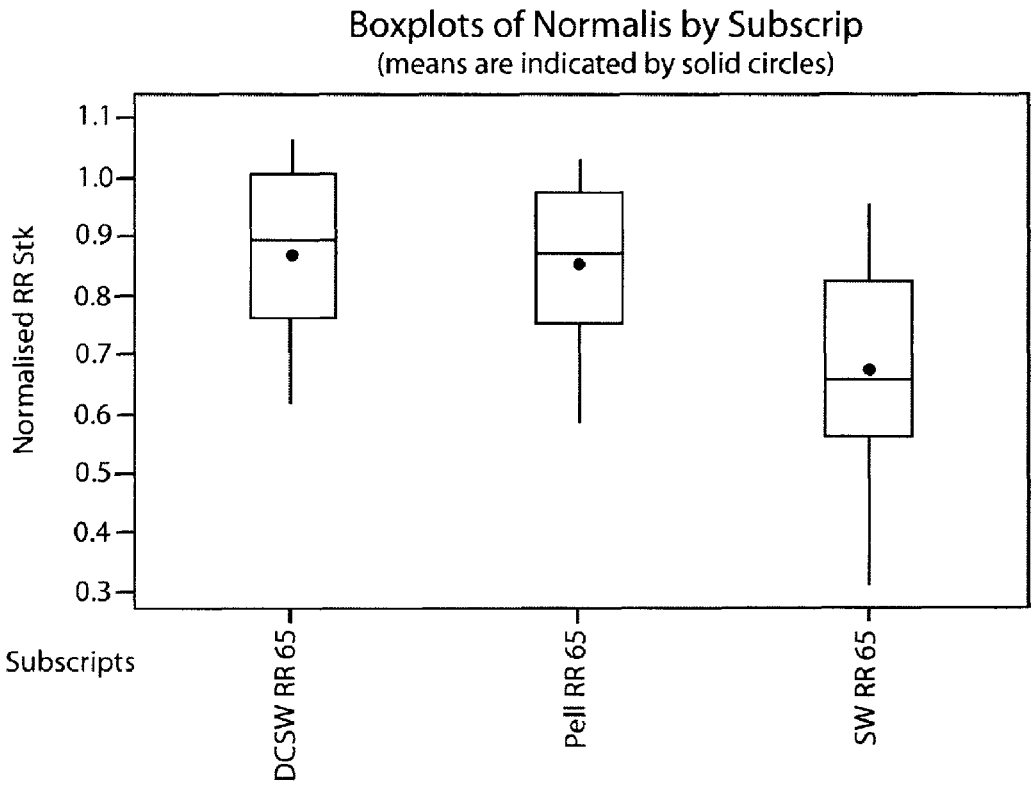
FIG. 10 shows a plot comparing the normalized removal rate of substrates ground with a stone grinding apparatus dressed in accordance with the invention and the prior art.

On the other hand, FIGS. 9 and 10 show that the double concentric solid wheel dressers of the invention yielded grind stones with a much higher removal rate than those dressed with the single solid wheel dressers. The grind stones dressed with the dressers of the invention yielded general removal rate averages (RR Stk) approaching that of the grind stones dressed with the pellet dressers. Thus, the grind stones in accordance with the invention could remove a stock amount of material nearly as quickly as the grind stones dressed by the pellet dressers. Further, the normalized removal rate (Normalis), which measures the removal rate above a threshold rate, was found to be slightly higher for the grind stones dressed with the inventive dressers than the pellet dressers, and considerably higher than the stones dressed with the single solid wheel dressers. Normalized removal rate differs from stock removal rate in that the grind stones are redressed at appropriate intervals and not made to continue dressing after the removal rate has fallen below an acceptable value.

As shown, the present invention advantageously provides, as by an apparatus and accompanying processing techniques which can be reliably practiced at low cost, improved methodologies and instrumentalities for forming disks to yield substrates with reliable inner and outer dimensions facilitating their use as substrates for high areal density thin film magnetic and/or MO recording media.

In the previous description, numerous specific details are set forth, such as specific materials, structures, reactants, processes, etc., in order to provide a better understanding of the present invention. However, the present invention can be practiced without resorting to the details specifically set forth. In other instances, well-known processing materials and techniques have not been described in detail in order not to unnecessarily obscure the present invention.

Only the preferred embodiments of the present invention and but a few examples of its versatility are shown and described in the present disclosure. It is to be understood that the present invention is capable of use in various other combinations and environments and is susceptible of changes and/or modifications within the scope of the inventive concept as expressed herein. The implementations described above and other implementations are within the scope of the following claims.

I claim:

1. A workpiece dresser apparatus, comprising:

a base defining a substantially planar surface terminating at a peripheral edge, the planar surface further terminating at opposing straight edges forming a groove intersecting the planar surface and longitudinally extending substantially orthogonally to the edge;

a first abrasive dressing element attached to the planar surface; and a second abrasive dressing element attached to the planar surface, an outer edge of the second abrasive dressing element noncontactingly separated from an inner edge of the first abrasive dressing element defining a space therebetween operably disposed in fluid communication with the groove in the base via an area of the space-to-groove intersection that extends entirely between the opposing edges of the abrasive dressing elements and entirely between the opposing edges of the groove.

2. The workpiece dresser of claim 1 wherein the first and second annular abrasive dressing elements are unitarily constructed.

3. The workpiece dresser of claim 1 wherein the first and second annular abrasive dressing elements each comprise an abrasive material deposited in a matrix material.

4. The workpiece dresser of claim 1 wherein the base defines a gear on a peripheral edge.

5. The workpiece dresser of claim 1 wherein the first and second annular abrasive dressing elements are concentric with respect to each other.

6. A method comprising:

obtaining a workpiece;

obtaining a workpiece dresser apparatus having a base defining a substantially planar surface terminating at a peripheral edge, the planar surface further terminating at opposing straight edges forming a groove intersecting the planar surface and longitudinally extending substantially orthogonally to the edge, a first abrasive dressing element attached to the planar surface, and a second abrasive dressing element attached to the planar surface, an outer edge of the second abrasive dressing element noncontactingly separated from an inner edge of the first abrasive dressing element defining a space therebetween operably disposed in fluid communication with the groove in the base via an area of the space-to-groove intersection that extends entirely between the opposing edges of the abrasive dressing elements and entirely between the opposing edges of the groove; and rotating the base to dress the workpiece with the first and second annular abrasive dressing elements.

7. The workpiece dresser of claim 3 wherein the abrasive material is sintered diamond and the matrix material is bronze.

8. The workpiece dresser of claim 1 wherein the circumferential space spans a substantially constant radial distance.

9. The workpiece dresser of claim 1 wherein the base is a first base and further comprising:

a second base;

a third abrasive dressing element attached to the second base; and a fourth abrasive dressing element attached to the second base, an outer edge of the fourth abrasive dressing element noncontactingly separated from the inner edge of the third abrasive dressing element defining a second space therebetween.

10. The workpiece dresser of claim 9 wherein the first and second bases are substantially coplanar, the first and second abrasive dressing elements are disposed on one side of the first base, and the third and fourth abrasive dressing elements are disposed on an opposing side of the second base.

11. The workpiece dresser of claim 10 comprising a plurality of coplanar bases, two or more coplanar bases of the plurality having respective abrasive dressing elements on the one side of the bases and two or more other coplanar bases of the plurality having respective abrasive dressing elements on the opposing side of the bases.

12. The workpiece dresser apparatus of claim 1 wherein the base defines a plurality of grooves each intersecting the planar surface.

13. A workpiece dresser apparatus, comprising:

a base defining a substantially planar surface terminating at a peripheral edge, the planar surface further terminating at opposing substantially parallel edges forming a groove intersecting the planar surface and longitudinally extending substantially orthogonally to the edge;

a first annular abrasive dressing element attached to the planar surface and covering at least a portion of the groove, an inner arcuate edge of the first annular abrasive dressing element defining a cavity; and a second annular abrasive dressing element attached to the planar surface in the cavity, an outer arcuate edge of the second annular abrasive dressing element noncontactingly separated from the inner arcuate edge of the first annular abrasive dressing element defining a circumferential space therebetween operably disposed in fluid communication with the groove in the base via an area of the space-to-groove intersection extending entirely between the opposing edges of the abrasive dressing elements and entirely between the opposing edges of the groove.

14. The apparatus of claim 1 wherein the groove intersects the peripheral edge.

15. The apparatus of claim 1 wherein the groove extends along a longitudinal axis that is substantially parallel to the planar surface.

16. The apparatus of claim 1 wherein at least one of the first abrasive element and the second abrasive element covers at least a portion of the groove.

17. The apparatus of claim 1 wherein the groove intersects an innermost edge of the base.

18. The apparatus of claim 1 wherein the abrasive dressing elements are each annular.

19. The apparatus of claim 1 wherein the opposing edges of the abrasive dressing elements are closer together than the opposing edges of the groove.

20. The apparatus of claim 1 wherein the opposing straight edges defining the groove are substantially parallel.

* * * * *